US010488823B2

(12) United States Patent
Sarchi et al.

(10) Patent No.: US 10,488,823 B2
(45) Date of Patent: Nov. 26, 2019

(54) TIMEPIECE MOVEMENT PROVIDED WITH A DEVICE FOR POSITIONING A MOVABLE ELEMENT IN A PLURALITY OF DISCRETE POSITIONS

(71) Applicant: Montres Breguet S.A., L'Abbaye (CH)

(72) Inventors: Davide Sarchi, Zurich (CH); Deirdre Lenoir, Le Sentier (CH); Benoit Legeret, Ecublens (CH)

(73) Assignee: Montres Breguet S.A., L'Abbaye (CH)

( * ) Notice: Subject to any disclaimer, the term of this patent is extended or adjusted under 35 U.S.C. 154(b) by 80 days.

(21) Appl. No.: 15/905,859

(22) Filed: Feb. 27, 2018

(65) Prior Publication Data

US 2018/0253061 A1 Sep. 6, 2018

(30) Foreign Application Priority Data

Mar. 6, 2017 (EP) ..... 17159361

(51) Int. Cl.
*G04B 19/253* (2006.01)

(52) U.S. Cl.
CPC ..... *G04B 19/25333* (2013.01)

(58) Field of Classification Search
CPC ..... G04B 19/25333; G04B 19/25353; G04B 15/14; G04B 15/08; G04B 17/06; G04C 5/005; G04C 3/022; G04C 3/024; G04C 5/00
USPC ..... 368/38
See application file for complete search history.

(56) References Cited

U.S. PATENT DOCUMENTS 3,518,825 A * 7/1970 Nissen ..... G04B 19/25373 368/37
3,710,567 A * 1/1973 Cleusix ..... G04B 19/25 368/35
4,261,046 A * 4/1981 Ono ..... G04C 17/0066 368/28

(Continued)

FOREIGN PATENT DOCUMENTS

EP 1 959 319 A1 8/2008
EP 2 998 799 A1 3/2016
EP 2 998 801 A1 3/2016

OTHER PUBLICATIONS

European Search Report dated Sep. 1, 2017, issued in European Application EP 17159361.9, filed Mar. 6, 2017 (with English Translation of Categories of Cited Documents).

*Primary Examiner* — Edwin A. Leon
(74) *Attorney, Agent, or Firm* — Oblon, McClelland, Maier & Neustadt, L.L.P.

(57) ABSTRACT

A timepiece movement includes a date ring having display positions, and a device for positioning the ring in a display position. The positioning device includes a lever and a first fixed magnet, a second magnet integral with the lever and a magnetic structure integral with the ring and moving between the two magnets, this magnetic structure being formed of a magnetically permeable material and having a radial dimension that varies periodically to define periods corresponding to the distances between the display positions. The magnetic axes of the two magnets are substantially aligned and their respective polarities are opposite. The magnetic torque applied to the lever can vary, so that it is pressed against the ring in the display positions but tends to move away from the ring on one part of the angular movement between these display positions.

12 Claims, 9 Drawing Sheets

(56) References Cited

U.S. PATENT DOCUMENTS

| | | | | |
|---|---|---|---|---|
| 4,409,576 | A | 10/1983 | Petersen | |
| 7,031,230 | B1 * | 4/2006 | Nagasaka | G04B 27/04 368/204 |
| 2017/0068222 | A1 | 3/2017 | Di Domenico | |

* cited by examiner

TIMEPIECE MOVEMENT PROVIDED WITH A DEVICE FOR POSITIONING A MOVABLE ELEMENT IN A PLURALITY OF DISCRETE POSITIONS

This application claims priority from European Patent Application No. 17159361.9 filed on Mar. 6, 2017; the entire disclosure of which is incorporated herein by reference.

FIELD OF THE INVENTION

The present invention concerns a timepiece provided with a device for positioning a movable element in a plurality of discrete positions. In particular, the invention concerns a device for positioning a date ring in a plurality of display positions.

BACKGROUND OF THE INVENTION

Conventionally, discs or rings used for the display of calendar data (date, day of the week, month, etc.) are held in any one of a plurality of display positions by a jumper (also called a jumper-spring). This jumper constantly presses against a toothing of the disc or ring in question. When changing from one display position to another, the jumper moves away from the toothing, undergoing a rotational motion in an opposite direction to the return force exerted by the spring of the jumper. Thus, the toothing is configured such that torque exerted on the jumper by its spring is minimal in the display positions and, when the disc or ring are driven, the jumper goes through a peak in torque. If it is desired to ensure positioning in the event of shocks, the toothing and the jumper must be designed, in particular the stiffness of the spring, such that the aforementioned peak in torque (maximum torque to be overcome to change the display) is relatively high. It is therefore difficult to dimension calendar discs or rings, in particular date rings, in timepiece movements, since a compromise must be found between guaranteeing the positioning function and minimising the energy consumption of the system when changing from one display position to another. Indeed, the spring cannot be too flexible, because it is necessary to ensure the immobilization of the disc or the ring, but it cannot be excessively stiff, because this would require a very high torque to be provided by a mechanism of the timepiece movement. In this latter case, the disc or ring drive mechanism may be bulky and there is a significant energy loss for the energy source incorporated in the timepiece movement during the driving of the disc or the ring.

SUMMARY OF THE INVENTION

It is an object of the present invention to overcome the problems associated with conventional jumpers and to propose a device for positioning a movable element, capable of occupying successively a plurality of discrete stable positions, which is reliable, relatively compact and which requires relatively little energy from the timepiece movement to change from one discrete stable position to another.

To this end, the present invention concerns a timepiece movement, comprising a movable element, which is capable of being driven along an axis of displacement and of being momentarily immobilised along said axis of displacement successively in a plurality of discrete stable positions, and a device for positioning this movable element in any one of the plurality of discrete stable positions. The positioning device comprises a lever and a magnetic system formed of a first magnet, a second magnet integral with the lever and a magnetic structure integral with the movable element, this magnetic structure being formed of a highly magnetically permeable material and having, relative to the axis of displacement, a transverse dimension that varies periodically to define a plurality of periods which respectively correspond, for the movable element, to the distances to be covered between the positions of the plurality of discrete stable positions. The first and second magnets are arranged such that their magnetic axes are in opposite directions, in projection onto a reference axis substantially passing through the respective centres of these first and second magnets, and respectively on either side of the magnetic structure so that, when the movable element is driven along its displacement axis from any one stable position to the next stable position, the magnetic structure moves between the first and second magnets. The magnetic system is also arranged such that, when the movable element is driven along its axis of displacement from any one stable position to the next stable position, a first magnetic torque exerted on the lever carrying the second magnet has a first direction over a first section and a second direction, opposite to the first direction, over a second section of the corresponding distance, the first direction corresponding to a return torque towards the movable element for a contact portion of said lever, whereas the second direction tends to move this contact portion away from the movable element. The magnetic structure is arranged along the axis of displacement such that, in each position of the plurality of discrete stable positions, the first magnetic torque is applied in the aforementioned first direction.

The magnetic system produces a second magnetic torque that is exerted directly on the magnetic structure and thus on the movable element. In a main variant, this second magnetic torque has a zero value, corresponding to a stable magnetic equilibrium position for the movable element, while the first magnetic torque is applied to the lever in the first direction.

In an advantageous variant, the lever is associated with a spring that exerts an elastic force on the lever so as to produce a mechanical torque that pushes the contact portion of the lever towards a toothing comprised in the movable element and which the contact portion penetrates to mechanically position the movable element.

In a main application, the movable element forms a display support for calendar information. In particular, the movable element is a date ring.

BRIEF DESCRIPTION OF THE DRAWINGS

The invention will be described in detail below with reference to the annexed drawings, given by way of non-limiting example, and in which.

DETAILED DESCRIPTION OF THE INVENTION

Figure 1:
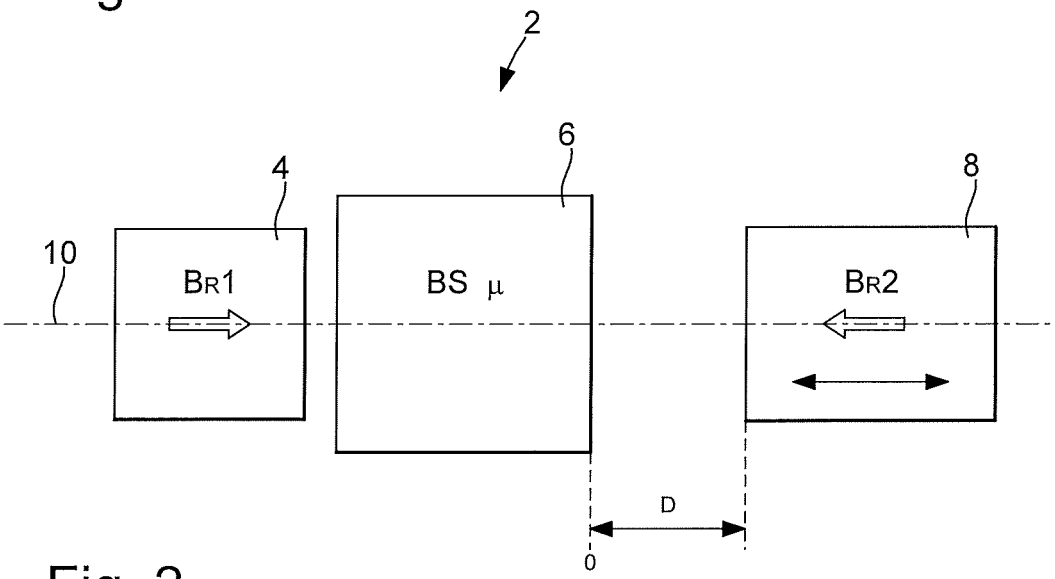
FIG. 1 schematically shows a magnetic system whose particular operation is used to advantage in the present invention.
Figure 2:
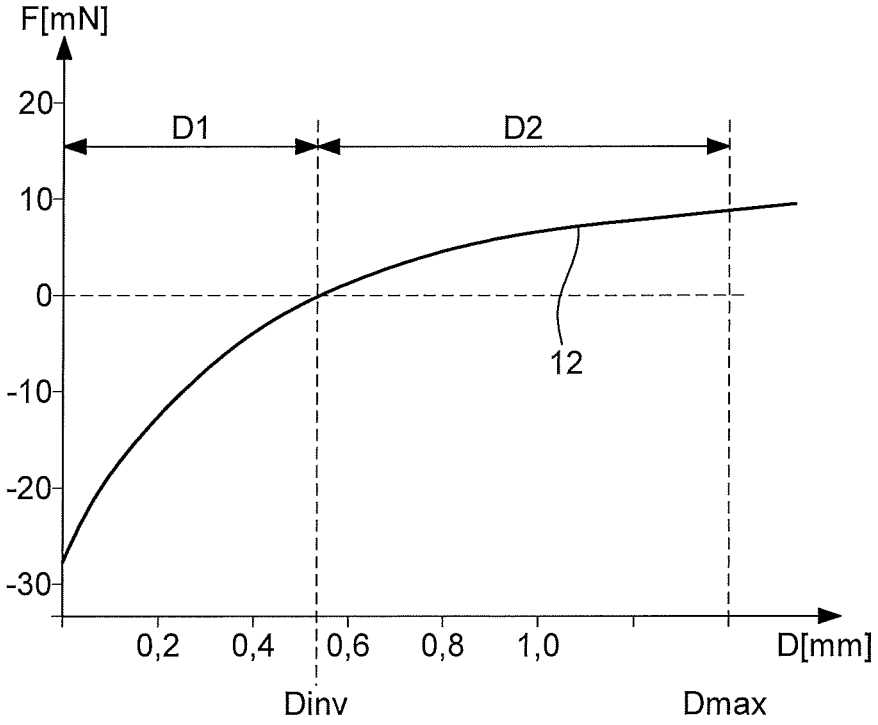
FIG. 2 represents a graph of the magnetic force experienced by a moving magnet of the magnetic system of FIG. 1 as a function of the distance separating it from a highly magnetically permeable element forming one part of this magnetic system.

Referring to FIGS. 1 and 2, we will start by describing a magnetic system ingeniously used to advantage by the present invention to make a device for positioning a movable element in a plurality of discrete stable positions.

Magnetic system 2 includes a first fixed magnet 4, a highly magnetically permeable element 6 and a second magnet 8 which is movable, along a displacement axis coincident here with the axis of alignment 10 of these three magnetic elements, with respect to the assembly formed by first magnet 4 and element 6. Element 6 is arranged between the first magnet and the second magnet, close to the first magnet and in a determined position relative to the latter. In a particular variant, the distance between element 6 and magnet 4 is less than or substantially equal to one tenth of the length of this magnet along its axis of magnetization. Element 6 consists, for example, of a carbon steel, tungsten carbide, nickel, FeSi or FeNi, or other alloys with cobalt such as Vacozet® (CoFeNi) or Vacoflux® (CoFe). In an advantageous variant, this highly magnetically permeable element consists of an iron or cobalt-based metallic glass. Element 6 is characterized by a saturation field $B_S$ and a permeability μ. Magnets 4 and 8 are, for example, made of ferrite, of FeCo or PtCo, of rare earths such as NdFeB or SmCo. These magnets are characterized by their remanent field Br1 and Br2.

Highly magnetically permeable element 6 has a central axis which is preferably substantially coincident with the axis of magnetization of first magnet 4 and also with the axis of magnetization of second magnet 8, this central axis being coincident here with axis of alignment 10. The respective directions of magnetization of magnets 4 and 8 are opposite. These first and second magnets thus have opposite polarities and are capable of undergoing a relative motion between them over a certain relative distance. The distance D between element 6 and moving magnet 8 indicates the distance of separation between this moving magnet and the other two elements of the magnetic system. It will be noted that axis 10 is arranged here to be linear, but this is a non-limiting variant. Indeed, the axis of displacement may also be curved, as in the embodiments that will be described hereinafter. In this latter case, the central axis of element 6 is preferably approximately tangent to the curved axis of displacement of the moving magnet and thus the behaviour of such a magnetic system is, at first glance, similar to that of the magnetic system described here. This is particularly so if the radius of curvature is large relative to the maximum possible distance between element 6 and moving magnet 8. In a preferred variant, as represented in FIG. 1, element 6 has dimensions in a plane orthogonal to central axis 10 which are greater than those of first magnet 4 and than those of second magnet 8 in projection into this orthogonal plane. It will be noted that, in the case where the second moving magnet is stopped against the highly magnetically permeable element at the end of travel, the second magnet advantageously has a hardened surface or a fine surface layer of hard material.

The two magnets 4 and 8 are arranged to repel each other so that, in the absence of highly magnetically permeable element 6, a force of magnetic repulsion tends to move these two magnets away from each other. However, surprisingly, the arrangement between these two magnets of element 6 reverses the direction of the magnetic force exerted on the moving magnet when the distance between this moving magnet and element 6 is sufficiently small, so that the moving magnet is then subjected to a force of magnetic attraction. Curve 12 of FIG. 2 represents the magnetic force exerted on moving magnet 8 by magnetic system 2 as a function of the distance D between the moving magnet and the highly magnetically permeable element. It is noted that the moving magnet is subjected overall, over a first range D1 of distance D, to a force of magnetic attraction which tends to hold the moving magnet against element 6 or to return it towards the latter if it is distant therefrom, this overall force of attraction resulting from the presence of the highly magnetically permeable (especially ferromagnetic) element between the two magnets, which permits a reversal of the magnetic force between two magnets arranged to magnetically repel each other, whereas this moving magnet is subjected overall, over a second range D2 of distance D to a force of magnetic repulsion. This second range corresponds to distances between element 6 and magnet 8 which are greater than the distances corresponding to the first range of distance D. The second range is limited in practice to a maximum distance $D_{max}$ which is generally defined by a stop limiting the separation distance of the moving magnet.

The magnetic force exerted on the moving magnet is a continuous function of distance D and thus has a value of zero at distance $D_{inv}$ at which the magnetic force reversal occurs (FIG. 2). This is a remarkable operation of magnetic system 2. The reversal distance $D_{inv}$, is determined by the geometry of the three magnetic components forming the magnetic system and by their magnetic properties. This reversal distance may thus be selected, to a certain extent, by the physical parameters of the three magnetic elements of magnetic system 2 and by the distance separating the fixed magnet from ferromagnetic element 6. The same applies to the evolution of the slope of curve 12, since the variation in this slope and, in particular, the intensity of the force of attraction when the moving magnet approaches the ferromagnetic element, can thus be adjusted.

Referring to FIGS. 3 to 6 and 7A to 7E, a first embodiment of the invention will be described below.

Timepiece movement 20 comprises a date ring 22 which is capable of being driven in rotation in the clockwise direction, along a circular axis of displacement 24, and of being momentarily immobilised along this axis of displacement successively in a plurality of discrete stable positions. The timepiece movement comprises a device for positioning the date ring in any one angular position of the plurality of discrete stable positions, this positioning device being formed of two complementary systems that are associated, namely a mechanical system, formed by a lever 30 associated with a spring 32, and by a toothing 26 comprising a plurality of hollows or notches 28, in which is successively inserted an end portion 31 of the lever (which defines a contact portion of the toothing) when the ring is successively positioned in the angular positions of said plurality of discrete stable positions, and a magnetic system formed of a first fixed magnet 34, a second magnet 36 integral with the lever and a magnetic structure 38 integral with ring 22.

Magnetic structure 38 is formed of a highly magnetically permeable material and, relative to the axis of displacement of ring 22, has a transverse dimension that varies periodically, defining a plurality of angular periods $\theta_P$ which correspond, for the movable ring, to the angular distances that it has to cover between its display positions (plurality of discrete stable positions). More particularly, in the variant described in FIGS. 3 and 4, the transverse dimension of the magnetic structure varies periodically between a maximum distance L1 and a minimum distance L2. This magnetic structure forms a crown with inwardly projecting portions 40 (magnetic teeth) and outwardly projecting portions 44 which are radially aligned on projecting portions 40. Thus, each pair of projecting portions 40 and 44 arranged on the same radius of the ring defines the maximum width L1 of the magnetic structure, while intermediate portions 42 define the minimum width L2. The pairs of projecting portions are radially aligned with notches 28 of toothing 26. Each pair of projecting portions and the respective notch define a radial axis corresponding to a stable display position $P_n$ (where n is a natural number) of ring 22. Each angular period $\theta_P$ is comprised between two successive maximum widths L1. In a variant, the toothing may be formed by the inner profile of the magnetic structure.

First magnet 34 and second magnet 36 are respectively arranged on either side of magnetic structure 38 with their magnetic axes substantially aligned on a reference axis $A_{REF}$ that they define (this axis passes substantially through their respective centres). The magnetic axes of the two magnets have opposite directions (magnets with opposite polarities). Next, these first and second magnets, and consequently lever 30, are arranged such that, when the date ring is driven along its axis of displacement 24, the magnetic structure moves between the two magnets. The physical phenomenon of the magnetic system described in FIGS. 1 and 2 is utilised, not by varying the distance along reference axis $A_{REF}$ of one of the two magnets relative to a magnetic structure integral with one or other of the magnets, but by a substantially orthogonal displacement of magnetic structure 38 relative to the reference axis, this magnetic structure having a variable width along the axis of displacement of the ring so that the magnetic force exerted by the magnetic system on the magnet carried by the lever, or respectively the magnetic torque exerted on the lever by the magnetic system, vary as a function of the angular position of ring 22, so that there is a reversal of direction of magnetic force (in projection onto the reference axis), or respectively a reversal of direction of magnetic torque when the ring moves over a distance corresponding to an angular period $\theta_P$.

Figure 5:
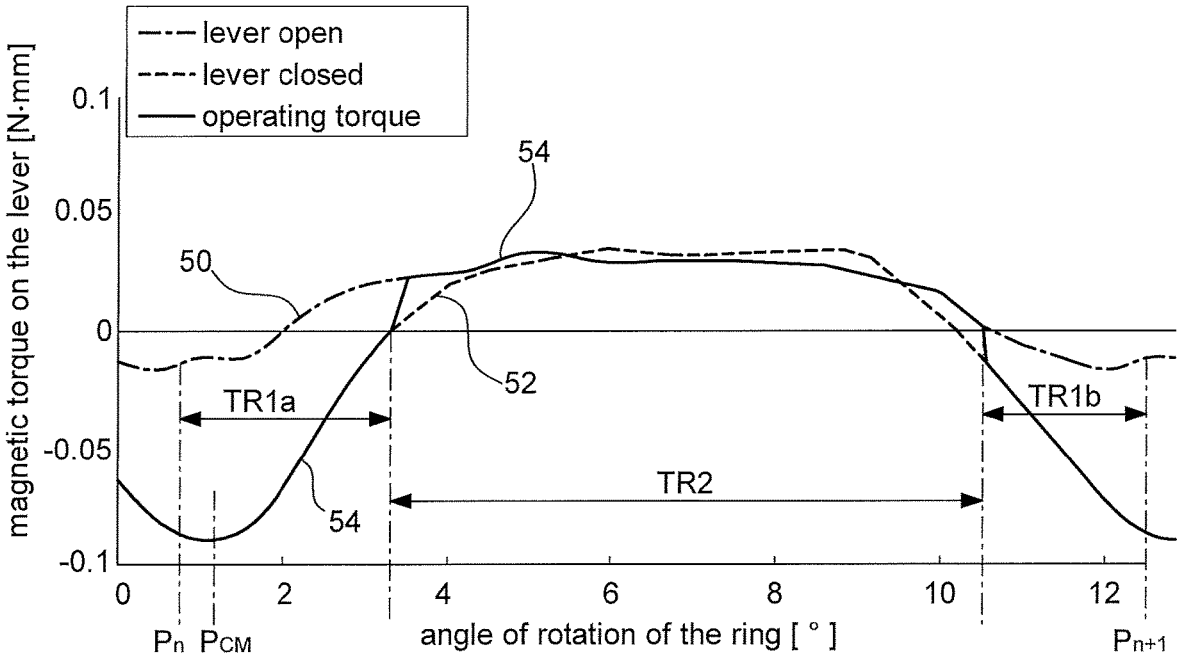
FIG. 5 graphically represents the magnetic torque exerted by the magnetic system, provided in the first embodiment, on the lever of the date ring positioning device.

FIG. 5 shows the evolution of the magnetic torque applied to the lever as a function of the angular position of the ring over an angular period $\theta_P$. This magnetic torque is arranged to be substantially maximum in a first direction (negative direction=anticlockwise direction), which presses portion 31 of the lever against ring toothing 26 when the ring is in any one of its angular display positions $P_n$ (discrete stable positions), and to diminish between these angular display positions, gradually moving away from said positions, to eventually undergo a reversal on an intermediate angular range, such that the magnetic torque then has, in this intermediate range, a second direction (positive direction), which tends to move end portion 31 away from the ring toothing. It will be noted that the magnetic torque described above forms a first magnetic torque for positioning ring 22 via the lever fixedly carrying magnet 36, this lever also forming a mechanical positioning system for the date ring.

Figure 6:
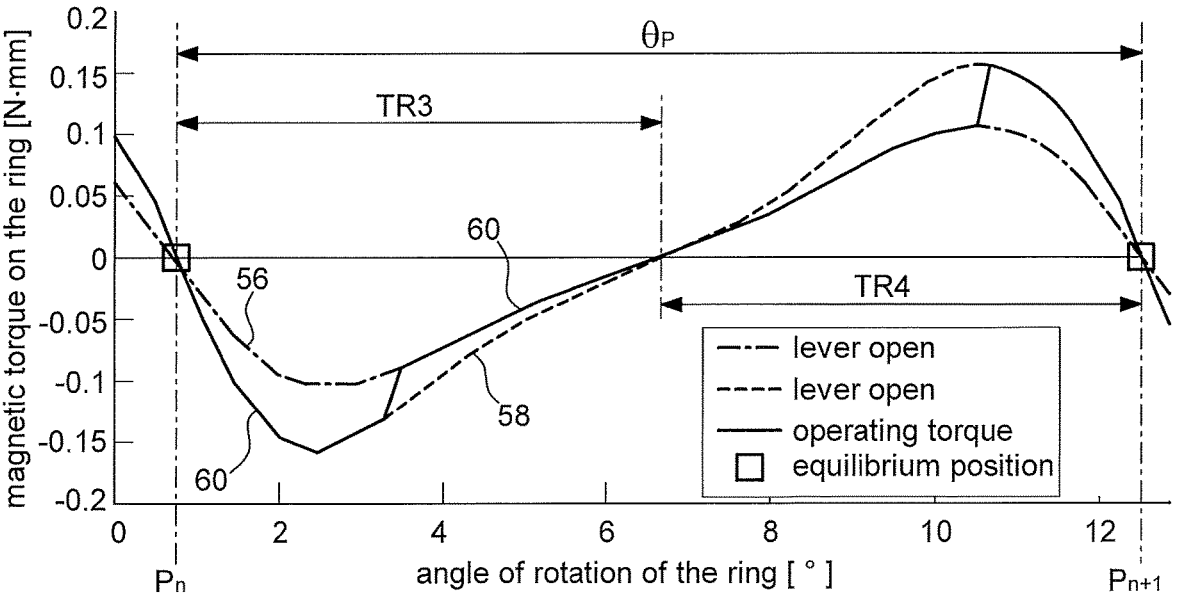
FIG. 6 graphically represents the magnetic torque exerted by the magnetic system of the positioning device on the magnetic structure of the date ring.

Further, the magnetic system of the positioning device of the invention further produces a second magnetic torque on ring 22 by means of a magnetic force exerted by the magnetic system directly on magnetic structure 38, this second magnetic torque strengthens the first magnetic torque since the magnetic structure (the magnetic toothing) is arranged such that the second magnetic torque is relatively low, preferably almost zero, when the ring is in any one of its angular display positions, and it increases relatively quickly on either side of each display position to resist, firstly, any movement of the ring out of the display position that it occupies, by returning the ring towards this display position. The evolution of the second magnetic torque is represented in FIG. 6. After the ring is driven over a certain angular distance from a display position $P_n$, the second magnetic torque decreases until it is eventually cancelled out substantially halfway through the angular period and then reverses its direction. It will be noted that this second magnetic torque is conservative in nature, i.e. the energy required, when the ring is driven over a first half-period, to overcome the return torque exerted on the magnetic structure, is substantially returned to the ring over the second half-period, since the second magnetic torque then has the same direction (positive direction) as the drive torque over this second half-period. For the various magnetic torque curves represented in FIGS. 5 and 6, the remanent field of each of the two magnets (neodymium iron boron) has a value of 1.35 T and the saturation field of the element made of ferromagnetic material (Vacoflux®) has a value of 2.2 T.

The graph of FIG. 5 represents:

a first curve 50 showing the magnetic torque exerted on the lever when the latter is in an open position (corresponding to a position in which end portion 31 is located outside toothing 26) and the ring is driven over an angular period $\theta_P$ between two successive display positions (i.e. from any one display position to the next display position);

a second curve 52 showing the magnetic torque exerted on the lever when the latter is in a closed position (corresponding to a position in which end portion 31 is located at the bottom of toothing 26, i.e. in a notch 28); and a third curve 54 approximately representing the operating magnetic torque applied to the lever over each angular period, this operating magnetic torque defining the first magnetic torque.

It will be noted that curve 52 is theoretical, since the lever cannot be held in a closed position during an angular movement of the ring over a distance corresponding to an angular period in the presence of the ring with its toothing 26. However, such a curve can be observed by taking a test ring with a profile in its general plane that corresponds to that of the magnetic structure. Operating torque curve 54 is an approximation of actual behaviour since the position of the lever depends not only on the first magnetic torque, but also on the profile of toothing 26, the profile of end portion 31 of the lever and the mechanical torque produced by the spring (it will be noted that the operating torque represented corresponds in fact to an embodiment without a spring and without a toothing). In the variant represented in FIGS. 3 and 4, it is noted that the notches have a profile intended to position the ring mechanically with limited play and to hold it correctly in the display positions. Thus, in this case, curve 54 only meets curve 52 in the angular zone close to stable display positions $P_n$. In any event, the operating magnetic torque substantially corresponds to that of curve 52 in each of display positions $P_n$.

The first magnetic torque exerted by the first magnet and the magnetic structure on lever 30 carrying the second magnet, as a function of the angular position of ring 22 (and thus of magnetic structure 38) over an angular period between two display positions of the ring, has a first direction (negative direction in FIG. 5) over a first section (formed of two parts TR1*a*, TR1*b* for an angular period corresponding to an angular movement of the ring between two stable magnetic positions) and a second direction, opposite to the first direction, over a second section TR2 of this angular period. The first direction corresponds to a return torque towards the movable ring for the contact portion of the lever, whereas the second direction tends to move this contact portion away from the ring and, in particular, from its toothing 26. Magnetic structure 38 is arranged along axis of displacement 24 such that, in each position $P_n$ of the plurality of discrete stable positions (display positions), the first magnetic torque is exerted in the aforementioned first direction. End portion 31 of lever 30 bears against toothing 26 of ring 22, at least when the first magnetic torque is applied to this lever in the first direction. In particular, the toothing and the lever are arranged such that end portion 31 is located at the bottom of the toothing in each discrete display position $P_n$.

It is observed that first part TR1*a* of the first section of a given period directly follows second part TR1*b* of the first section of the period that precedes this given period. Thus, between the two sections TR2, the first magnetic torque is applied in the first direction over continuous sections each formed of a first part TR1*a* and a second part TR1*b* respectively located on either side of a stable position $P_n$. Preferably, the first magnetic torque (operating torque 54) has a maximum negative value (i.e. maximum in absolute value) for an angular position $P_{CM}$ close to each discrete stable position $P_n$. In an advantageous variant, this maximum negative value is substantially attained in each discrete stable position $P_n$.

It will be noted that end portion 31 of the lever which presses against the toothing here includes the second magnet 36. In the represented variant, the non-magnetic support forming this end portion and carrying the second magnet is arranged to abut against toothing 26 such that said second magnet can approach magnetic teeth 40 without, however, entering into contact with the ring. In a variant, the second magnet has a surface in contact with the toothing, this contact surface being hardened by a suitable treatment. In another variant, the portion of the second magnet located on the toothing side is protected by a protective layer deposited on the second magnet, this protective layer being in contact with the toothing.

The graph of FIG. 6 represents:

a first curve 56 showing the magnetic torque applied to the magnetic structure, and thus directly to the ring when the lever is in an open position and the ring is driven over an angular period $\theta_P$;

a second curve 58 showing the magnetic torque applied to the magnetic structure when the lever is in a closed position; and a third curve 60 approximately representing the operating magnetic torque applied to the magnetic structure over each angular period, this operating magnetic torque defining a second magnetic torque occurring in the positioning device of the invention.

It will be noted again that curve 58 is a theoretical curve, since the lever cannot be held in a closed position when the ring is being driven over an entire angular period because of toothing 26, and operating torque curve 60 is an approximation of real behaviour since the position of the lever depends, in particular, on the profile of toothing 26 and the profile of end portion 31 of the lever.

The second magnetic torque has a substantially zero value in position $P_n$ defining the start of an angular period between two display positions. In each position $P_n$ (where n is a natural number), the magnetic structure and consequently ring 22 are in a stable magnetic position, since the negative slope of curve 60 in this position $P_n$ indicates that the second magnetic torque tends to return the ring to this position when it moves away therefrom (positive direction of the angle of rotation is the clockwise direction). Preferably, the ring and the lever are arranged so that each position $P_n$ of the plurality of discrete stable positions corresponds to a stable magnetic position, as is the case in the first embodiment. The first magnetic torque is applied to the lever in the first direction when the ring is in any stable magnetic equilibrium position. In an advantageous variant represented in FIGS. 5 and 6, the maximum negative value of the first magnetic torque is attained in angular positions close to the stable magnetic equilibrium positions. Thus, for each stable magnetic position of the date ring, the first magnetic torque exerted on the lever has a value close to the maximum value of said first magnetic torque in the first section wherein the first magnetic torque is exerted in the first direction. In a preferred variant, the lever and the magnetic system are arranged such that said maximum value is substantially attained in each stable magnetic position, which corresponds to a display position of the date ring.

The second magnetic torque 60 has, in each angular period, a negative value over a first section TR3 and a positive value over a second section TR4. These two sections each extend substantially over a half-period. It will be noted that this second magnetic torque has a zero value between these two sections, this position corresponding to an unstable magnetic equilibrium position. In this position, reference axis $A_{REF}$ moves substantially between two magnetic teeth 40 and consequently between two notches or hollows 28 of toothing 26, these notches or hollows being radially aligned with magnetic teeth 40.

The pressure from spring 32 on the lever produces a mechanical torque applied by the lever to ring 22. It will be noted that this mechanical torque can be relatively low, given the first and second magnetic torques produced by the magnetic system that are exerted on the ring in the same direction as the mechanical torque when the ring is in any one of the plurality of display positions. It will also be noted that the mechanical torque can be greater than the first magnetic torque applied in the second direction, i.e. than its maximum positive value on second section TR2, such that lever portion 31 remains continuously bearing against lever toothing 26. However, in another variant, the mechanical torque is lower than this maximum positive value over a certain angular pivoting distance of the lever. However, in this latter case, the spring stiffness is advantageously selected such that said spring limits, in second section TR2, the distance separating magnet 36, carried by lever end portion 31, from magnetic structure 38. It this is not the case, then an element of the timepiece movement must have a stop function for the lever when portion 31 moves away from the toothing, so as to limit the distance separating it from the toothing in second section TR2 of each period.

It will be noted that the two magnetic forces, which are exerted respectively on the lever, via the magnet carried thereby, and on the ring, via the magnetic structure carried thereby or of which it is formed, are vectors that each have a certain amount of variable intensity and also a variable direction in the general plane of the ring and of the lever. These two parameters (intensity and direction) are involved in the first magnetic torque and in the second magnetic torque. The first magnetic torque is defined relative to the axis of pivoting of the lever, while the second magnetic torque is defined relative to the geometric axis of rotation of the ring.

Figure 3:
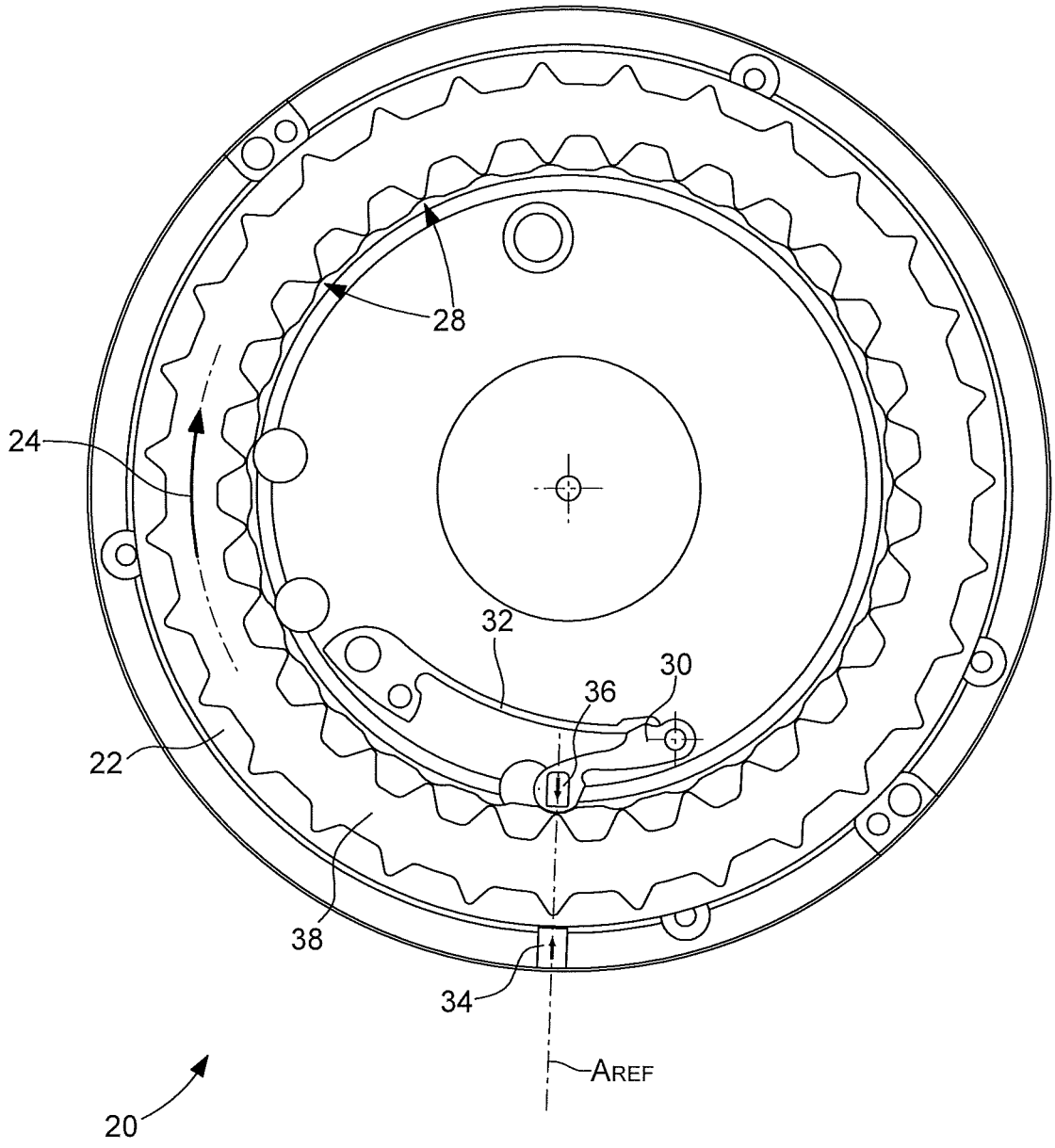
FIG. 3 is a plan view of a first embodiment of a timepiece movement according to the invention comprising a date ring and a device for positioning the latter.
Figure 4:
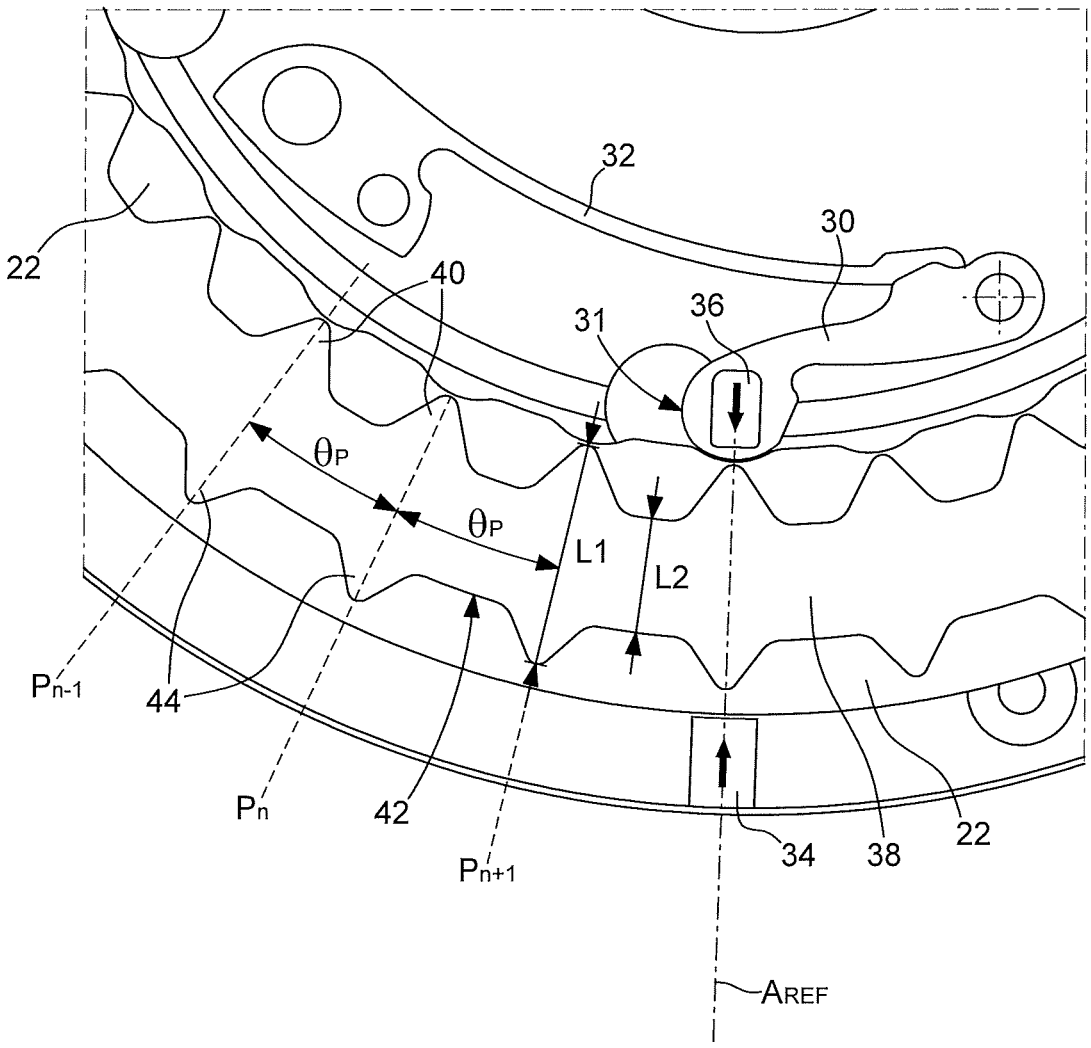
FIG. 4 is an enlarged, partial view of FIG. 3.
Figure 7A:
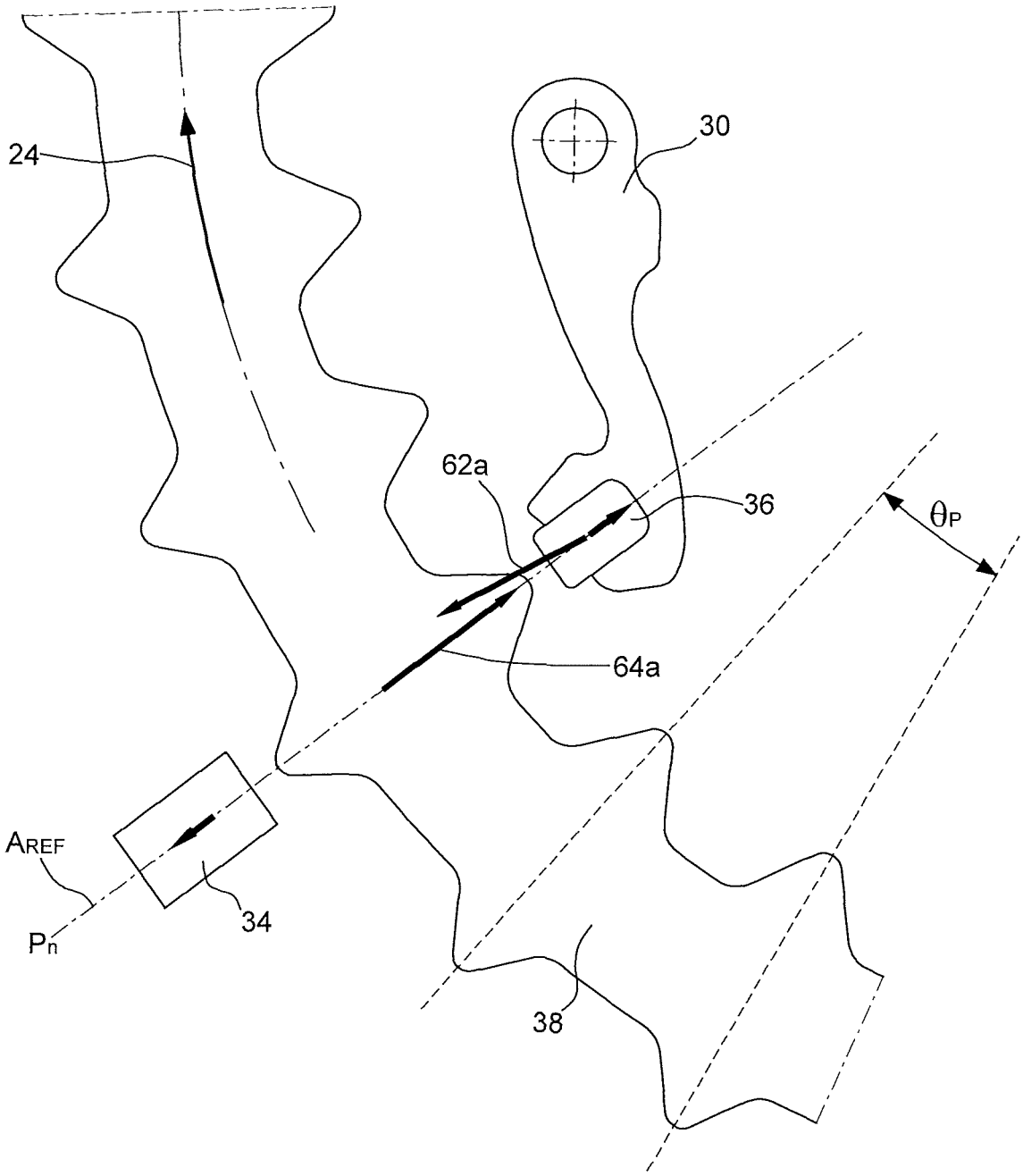
FIGS. 7A to 7E represent in succession the orientation of the forces that are exerted on the lever and on the date ring during the driving of the latter over a period between two stable display positions.
Figure 7B:
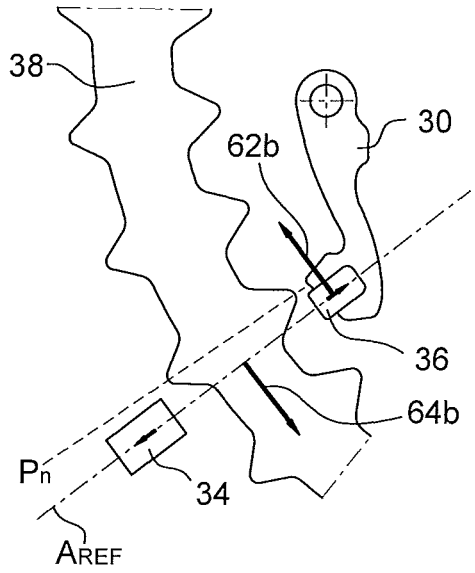
Figure 7C:
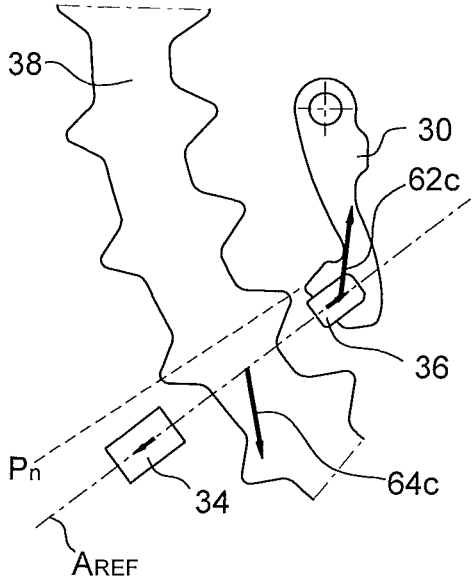
Figure 7D:
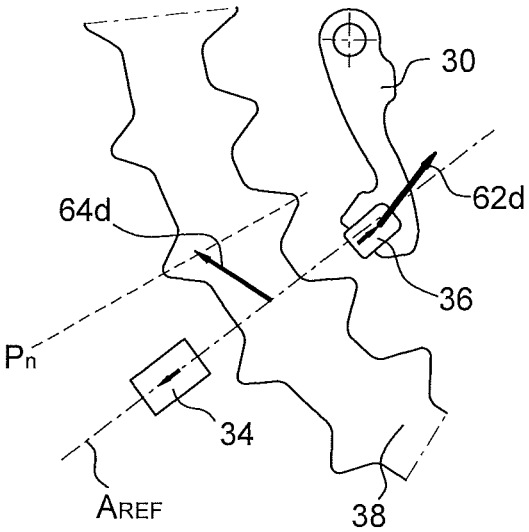
Figure 7E:
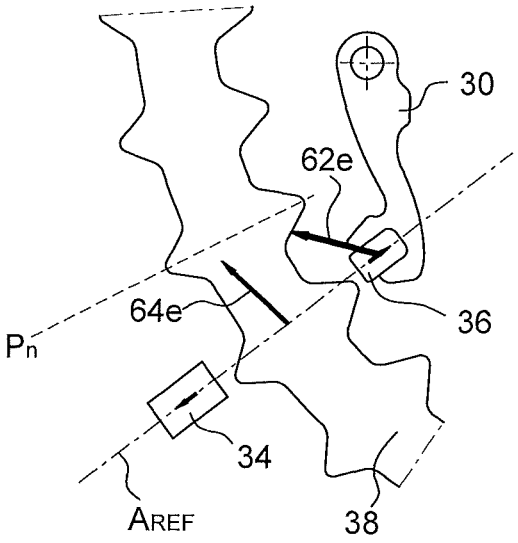

In a variant embodiment, with a lever arranged symmetrically to the lever represented in FIGS. 3 and 4 (which reverses the signs in FIG. 5 for the torques that are exerted on the lever), there is represented in FIGS. 7A to 7E, on the one hand, respectively the force vectors 62*a* to 62*e* exerted on lever 30 in various angular positions of the date ring when the ring is driven in the clockwise direction, and on the other hand, respectively the force vectors 64*a* to 64*e* exerted on magnetic structure 38, carried by the ring, in these various angular positions. FIG. 7A corresponds to a display position of the ring wherein force vector 64*a* is radially oriented, which corresponds to a zero value of second magnetic torque and to a stable equilibrium position. The first magnetic torque is substantially maximum in the positive direction (direction in which the free end of the lever presses against the ring). This first magnetic torque is added here to the mechanical torque exerted by a spring (not represented) on the lever. FIG. 7B shows a situation wherein the first magnetic torque is still positive (clockwise direction), but greatly decreased, and the second magnetic torque is negative (anticlockwise direction). The second magnetic torque opposes here angular movement of the ring in the clockwise direction (drive direction). In FIG. 7C, the first magnetic torque has become negative and the second magnetic torque remains negative. In FIG. 7D, force vector 62*d* has a substantially opposite direction to force vector 62*a* of FIG. 7A, these two vectors being approximately radially oriented. There is thus a reversal of the magnetic force exerted on moving magnet 36 when the ring is driven from a given position in FIG. 7A to a given position in FIG. 7D. It is noted that force vector 64*d* has become positive in FIG. 7D, the ring then also being driven by the second magnetic torque in its angular movement. In FIG. 7E, the first magnetic torque has become positive again before the next display position is reached, the lever thus pressing once more against the ring, while the second magnetic torque is still driving the ring towards the next display position.

Figure 8:
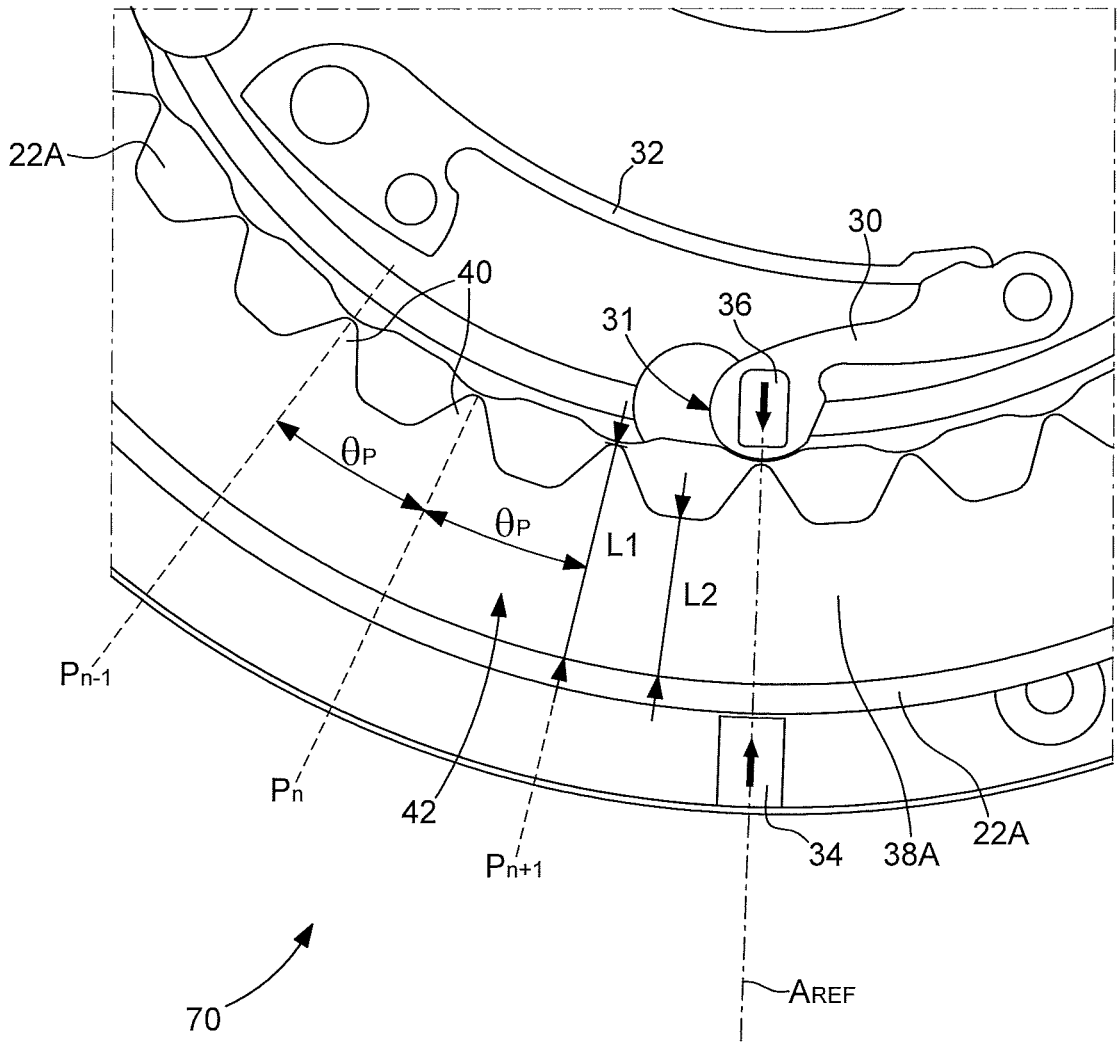
FIG. 8 is a plan view of a variant of the first embodiment.

In FIG. 8 represents a variant embodiment that differs from that of FIGS. 3 and 4 in that magnetic structure 38A integral with date ring 22A has a circular profile on the side of fixed external magnet 34. Thus, regardless of the angular position of the ring, the distance between the magnetic structure and the external magnet is constant. The variation in width of the magnetic structure is thus obtained here only by the inner magnetic toothing formed of teeth 40 of said structure. The behaviour of the magnetic system of this timepiece movement 70 is essentially similar to that of the previously described variant.

Figure 9:
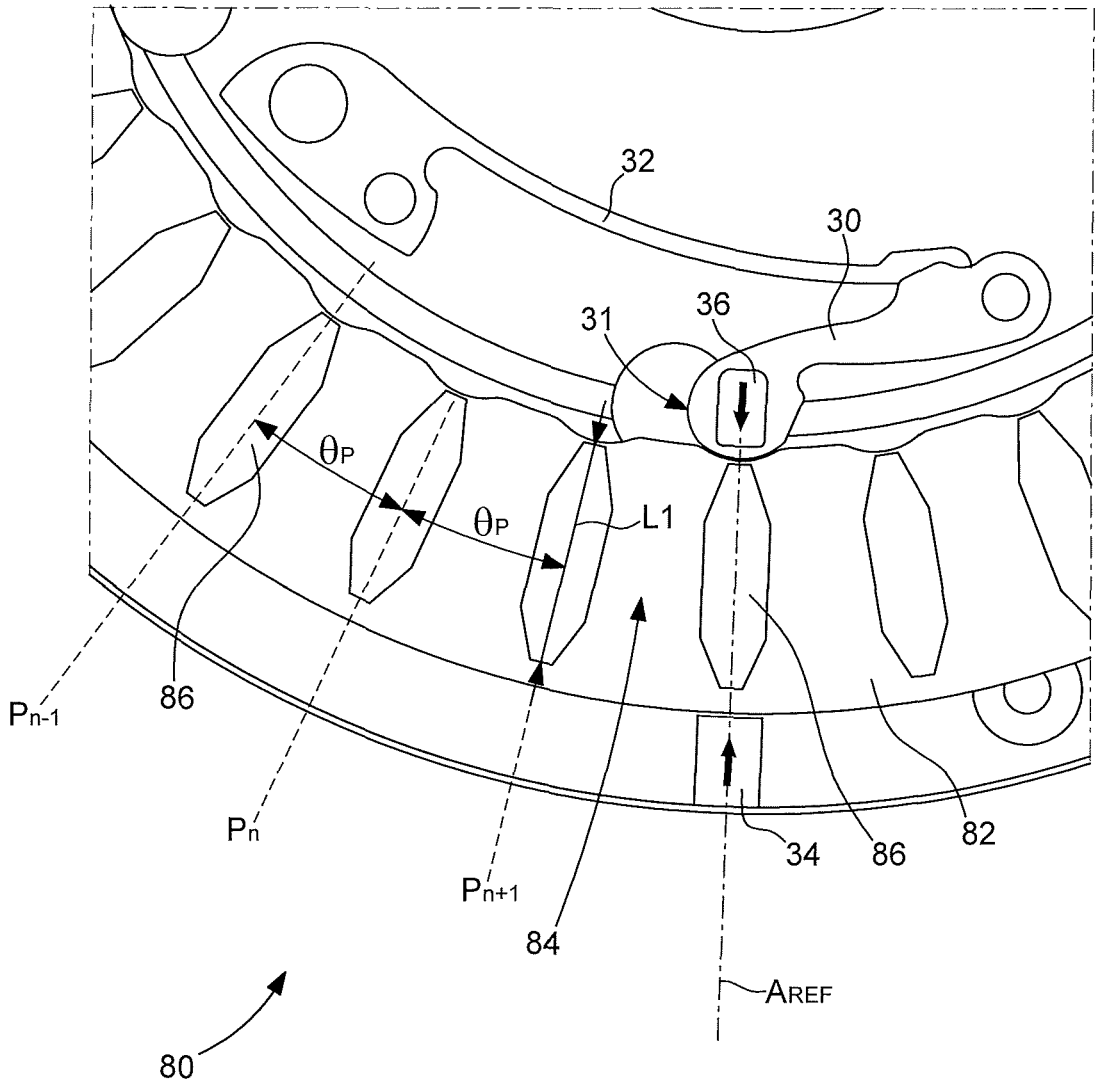
FIG. 9 is a plan view of a second embodiment of a timepiece movement according to the invention.

A second embodiment of the invention is represented in FIG. 9. References that have already been described, and the operation of the magnetic system, will not be described in detail again here. It will be noted that this operation is essentially similar to that of the first embodiment. The second embodiment of a timepiece movement 80 according to the invention differs from the first embodiment as regards the shape of the magnetic structure. While in the first embodiment, the magnetic structure extends continuously along the movable element on its axis of displacement, magnetic structure 84, carried by date ring 82, is formed of a plurality of distinct magnetic elements 86. These magnetic elements are respectively radially aligned on the plurality of notches 28 of toothing 26 of ring 82. The alignment of each magnetic element on reference axis $A_{REF}$ defines a different discrete stable position for the ring and thus a different display position. Magnetic structure 84 is thus formed of a plurality of distinct magnetic elements 86 formed of a highly magnetically permeable material, particularly a ferromagnetic material. These magnetic elements 86 are arranged along the ring on axis of displacement 24 with a space containing no highly magnetically permeable material between any two successive distinct elements.

As in the first embodiment, the first and second magnetic torques act in concert with the mechanical torque produced by spring 32 to position the ring in any one of the plurality of display positions and to hold it in this position when the ring is not driven by its drive mechanism arranged in the timepiece movement (mechanism known to those skilled in the art). It will be noted that the drive mechanism must overcome the first and second magnetic torques and the mechanical torque to drive the ring from one stable display position to the next stable display position. However, as already stated, the second magnetic torque is substantially conservative. Likewise, the first magnetic torque and the mechanical torque can return a certain amount of energy to the ring in the second half of the movement between two stable display positions. This also depends on the toothing profile and, of course, on the friction force of the lever on the ring toothing.

Apart from the two magnetic torques that act in concert on the ring to position and stabilise it, the positioning device according to the invention is remarkable in that the first magnetic torque that is exerted on the lever decreases quickly once the end portion 31 of the lever starts to leave one of notches 28 and then changes sign when the ring is driven further forward to change from one display position to another. In other words, the magnetic torque decreases as soon as the lever is moved away from the ring via its toothing, which thus quickly decreases the magnetic positioning torque immediately on drawing away from a discrete stable position. Indeed, when the lever moves away from the toothing, the first magnetic torque decreases quickly and is even reversed, which greatly facilitates passage over a tooth and therefore requires little energy. It will be noted that this behaviour is the reverse of the mechanical torque exerted by the spring on the lever, since the mechanical return force towards the ring increases when the end portion of the lever leaves a notch, or, more generally, when it draws away to allow passage over a tooth of the positioning toothing (which may also serve to drive the ring).

The magnetic elements 86 have an oblong shape with two truncated ends. In a variant, these magnetic elements simply have a rectangular shape. Referring to FIGS. 1 and 2, it is understood that the magnetic system is arranged such that the magnet carried by the lever undergoes a force of attraction towards the ring toothing when a magnetic element is inserted between this moving magnet 36 and fixed magnet 34. However, when the reference axis passes between two adjacent magnetic elements, in particular in the middle of these two elements, magnet 36 undergoes a force of repulsion oriented substantially towards the centre of rotation of the ring.

Figure 10:
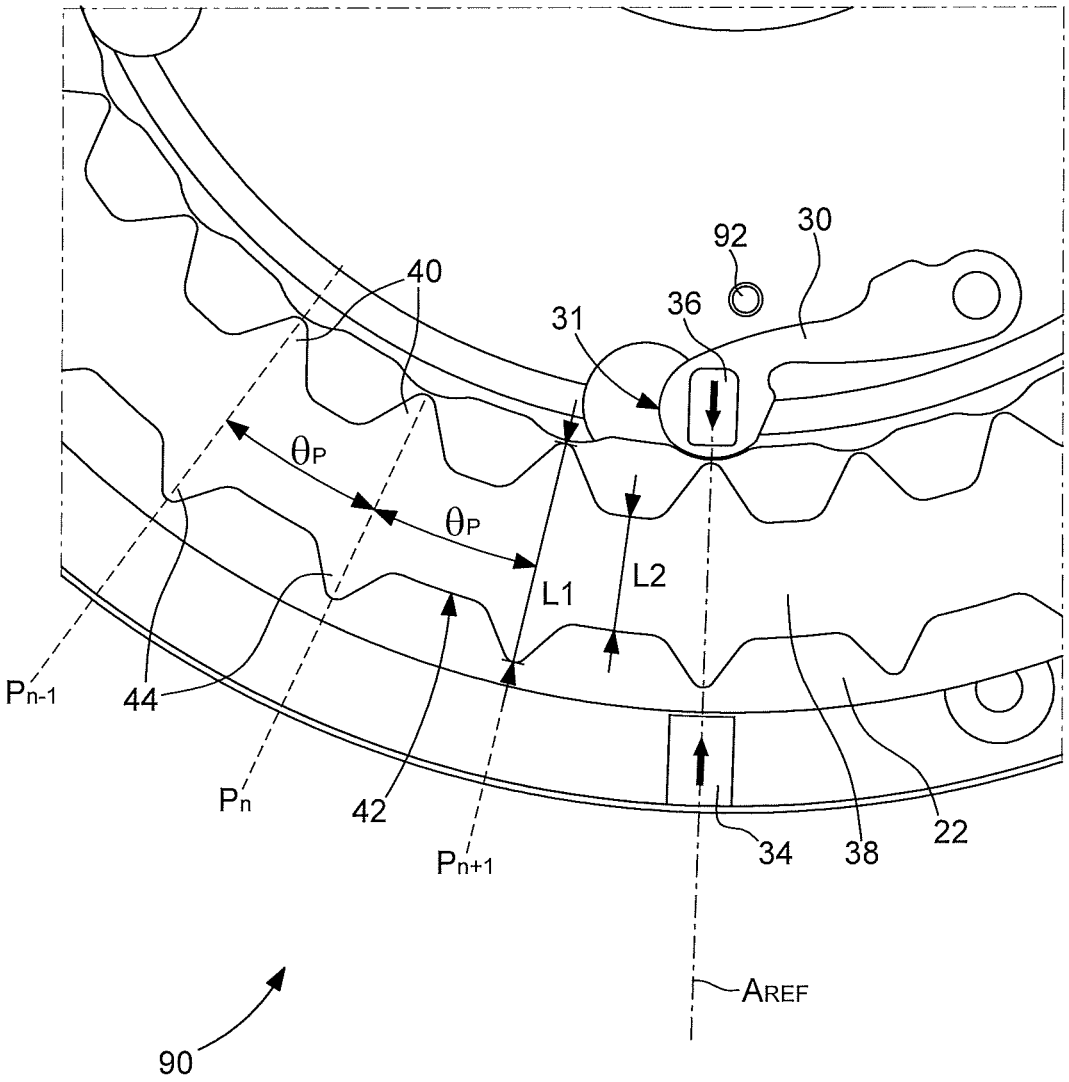
FIG. 10 is a plan view of a third embodiment of a timepiece movement according to the invention.

Finally, a third embodiment of a timepiece movement 90 according to the invention is shown in FIG. 10. This third embodiment differs from the two preceding ones in that no mechanical torque is produced by the positioning device. Thus, there is no spring associated with lever 30 here. However, a stop 92 is provided to limit the rotation of the lever in the clockwise direction (positive direction in the present description), when the first magnetic torque becomes positive, and to prevent the lever finding itself in an angular position wherein the magnetic torque that is exerted thereon in the open position no longer permits a return towards the toothing 26 when end portion 31 again appears facing a notch 28 of the toothing. Indeed, the magnetic system must be able to return the lever against the toothing by itself. Referring to FIG. 5, it is seen that the first negative torque remains negative around discrete stable positions $P_n$ when the lever moves from a closed position to an open position. This is important for this third embodiment. Thus, when moving from one display position to the next, as soon as the end portion of the lever is approximately facing the next notch, the magnetic torque applied thereto allows it to be driven into the notch and thus towards the closed position. The design of the elements of the magnetic system and their spatial arrangement and the arrangement of the lever, in particular its axis of pivoting, are arranged such that the magnetic torque in the open position of the lever is sufficient to drive its end portion to the bottom of the toothing from the open position, namely here to the bottom of a notch, when the latter appears facing the end portion. In particular, the design of the magnets and their magnetic features allow for adjustment especially of the first magnetic torque.

What is claimed is:

1. A timepiece movement comprising a movable element, which is capable of being driven along an axis of displacement and of being momentarily immobilized in any one stable position of a plurality of discrete stable positions, and a device for positioning said movable element in any one of the plurality of discrete stable positions, wherein the positioning device comprises a lever and a magnetic system formed of a first magnet, a second magnet integral with the lever and a magnetic structure integral with the movable element, said magnetic structure being formed of a highly magnetically permeable material and having, relative to said axis of displacement, a transverse dimension that varies periodically to define a plurality of periods respectively corresponding to the distances to be covered by the movable element between the positions of the plurality of discrete stable positions; wherein the first and second magnets are arranged such that their magnetic axes are in opposite directions, in projection onto a reference axis passing through the respective center of said first and second magnets, and respectively on either side of the magnetic structure so that, when the movable element is driven along its displacement axis from any one stable position to a next stable position, the magnetic structure moves between the first and second magnets, the magnetic system being further arranged such that, when the movable element is driven along its axis of displacement, from any one stable position to the next stable position, a first magnetic torque exerted on the lever carrying the second magnet has a first direction over a first section and a second direction, opposite to the first direction, over a second section of the corresponding distance, said first direction corresponding to a return torque towards the movable element for a contact portion of said lever; and wherein the magnetic structure is arranged along said axis of displacement such that, in each position of the plurality of discrete stable positions, said first magnetic torque is applied in said first direction.

2. The timepiece movement according to claim 1, wherein said reference axis is orthogonal to said axis of displacement; and wherein the first and second magnets are arranged such that their magnetic axes are substantially aligned on said reference axis.

3. The timepiece movement according to claim 1, wherein the magnetic system produces a second magnetic torque that is exerted directly on the magnetic structure and thus on the movable element, said second magnetic torque having a zero value, corresponding to a stable position of magnetic equilibrium for the movable element, whereas the first magnetic torque is applied in said first direction to said lever.

4. The timepiece movement according to claim 3, wherein said movable element and said lever are arranged such that each position of said plurality of discrete stable positions corresponds to a stable magnetic position.

5. The timepiece movement according to claim 4, wherein, in each stable magnetic position of the movable element, the first magnetic torque applied to the lever has a value equal to the maximum value of said first magnetic torque in said first section.

6. The timepiece movement according to claim 1, wherein the movable element or the magnetic structure comprises a toothing against which comes to bear said contact portion of the lever at least when said first magnetic torque is applied in said first direction to said lever, the toothing and the lever being arranged such that said contact portion is located at the bottom of said toothing in each position of said plurality of discrete stable positions.

7. The timepiece movement according to claim 6, wherein said lever is associated with a spring which exerts an elastic force on said lever to produce a mechanical torque on said contact portion that pushes the latter towards said toothing.

8. The timepiece movement according to claim 1, wherein said magnetic structure extends continuously along the movable element on said axis of displacement.

9. The timepiece movement according to claim 1, wherein said magnetic structure is formed of a plurality of distinct magnetic elements arranged along the movable element on said axis of displacement to define said plurality of periods and with a space containing no highly magnetically permeable material between any two successive magnetic elements.

10. Timepiece movement according to claim 1, wherein said movable element has an annular shape, said movable element being arranged to rotate on itself so that said axis of displacement is a circular axis.

11. The timepiece movement according to claim 10, wherein the movable element forms a display support for calendar information.

12. The timepiece movement according to claim 11, wherein the movable element is a date ring.

* * * * *